US006715178B2

(12) United States Patent
Graceffo

(10) Patent No.: US 6,715,178 B2
(45) Date of Patent: Apr. 6, 2004

(54) FLOOR POLISHER CONVERSION KIT

(76) Inventor: Pasquale Graceffo, 3761 W. Hillsboro, Coconut Creek, FL (US) 33073

( * ) Notice: Subject to any disclaimer, the term of this patent is extended or adjusted under 35 U.S.C. 154(b) by 0 days.

(21) Appl. No.: 10/161,809

(22) Filed: Jun. 5, 2002

(65) Prior Publication Data

US 2003/0226225 A1 Dec. 11, 2003

(51) Int. Cl.[7] ..... A47L 11/02; A47L 11/40

(52) U.S. Cl. ..... 15/98; 15/49.1; 15/145; 16/426

(58) Field of Search ..... 15/1, 49.1, 98, 15/144.1, 144.3, 144.4, 145; 451/353; 16/426, 427

(56) References Cited

U.S. PATENT DOCUMENTS

| | | | | |
|---|---|---|---|---|
| 981,032 | A | | 1/1911 | Strange |
| 1,847,323 | A | | 3/1932 | Yutzler et al. |
| 2,561,279 | A | | 7/1951 | Holt |
| 2,702,395 | A | * | 2/1955 | Zaiger |
| 2,936,475 | A | * | 5/1960 | Johns |
| 3,074,089 | A | | 1/1963 | Brown, Jr. |
| 3,204,272 | A | * | 9/1965 | Greene |
| 3,264,674 | A | | 8/1966 | Doyle, Jr. et al. |
| 3,631,559 | A | * | 1/1972 | Gaudry |
| 4,112,576 | A | | 9/1978 | Gross |
| 4,115,890 | A | | 9/1978 | Burgoon |
| 4,358,868 | A | | 11/1982 | Cook, Jr. |
| D296,250 | S | | 6/1988 | Genovese |
| 5,253,384 | A | | 10/1993 | Joines et al. |
| 5,360,111 | A | * | 11/1994 | Arispe |
| 5,400,471 | A | * | 3/1995 | Lichfield |
| 5,609,255 | A | * | 3/1997 | Nichols |
| 5,797,157 | A | | 8/1998 | Gregg |
| 6,353,957 | B1 | | 3/2002 | Wolfe et al. |
| 2003/0061676 | A1 | * | 4/2003 | Warren |

FOREIGN PATENT DOCUMENTS

| | | | |
|---|---|---|---|
| IT | 619913 | * | 5/1961 |

* cited by examiner

*Primary Examiner*—Randall Chin
(74) *Attorney, Agent, or Firm*—McHale & Slavin, P.A.

(57) ABSTRACT

Disclosed is a device for use with a conventional automobile hand polisher for use in polishing of floors. The device includes a detachable handle having a storage bin and an actuation leaver. The handle provides control of a high speed polisher in a stand-up position, the storage bin provides an area for the placement of weight and for storing of all items upon when not in use. By use of the disclosed handle, a high speed lightweight orbital polisher can be employed for providing a high gloss finish to most floor surfaces.

22 Claims, 1 Drawing Sheet

FLOOR POLISHER CONVERSION KIT

FIELD OF THE INVENTION

This invention relates to floor polishing and in particular to a device for polishing of floors using a conventional high speed orbital hand polisher.

BACKGROUND OF THE INVENTION

Polishing of floors is a difficult and tedious job made even more troublesome by the weight of equipment. Floor polishers are typically formed from a one piece structure having an integrated handle such as that disclosed in U.S. Design Pat. No. 296,250. These commercial grade devices are heavy making there use limited to periodic application and are expensive in light of there limited production. Most such devices are useful only in institutions and industry.

Commercial and industrial polishers generally employ a polishing wheel upon which a motor is mounted. The motor weighs down the polishing wheel to enhance operation. The motor/polishing wheel combination produce a large torque which can be difficult to control. Even if the operator of the assembly is large, over a period of time the control of the assembly can prove most tiring.

Floor polishing services are not limited to the maintenance of a single floor and the need for moving floor polishing equipment is recognized. However, due to the weight of the units, the floor polishers do not take full advantage of the devices and typically regulate floor polishing duties as a once a month chore.

U.S. Pat. No. 5,797,157 discloses a battery powered floor buffer having a polisher located at one end of support and a battery operated motor located at the other end. This device is intended for use in the home as an alternative to the heavy industrial polishers.

Conventional floor buffing equipment utilize flat, circular buffing pads. When powered by an electric motor, the pads are rotated at a speed usually between 175 and 1000 rpm, although some operate at speeds as high as 2000 rpm. In order to obtain a superior finish on a waxed floor, it is necessary to generate enough friction and heat to actually melt the top layer of wax on the floor. Relatively low speed vertical axis machines typically mount the motor centrally on the floor treating element. The element is then evenly pressed onto the floor surface by the weight of the machine. The machine is moved in a sweeping arc by application of pressure on the control handle. Low speed machines typically operate in the 300 to 400 rpm range. An example of one such floor treating machine may be found in U.S. Pat. No. 3,264,674 entitle Floor Treating Machines. High speed machines, typically operating at about 1000 rpm, typically include a pair of ground engaging wheels to prevent the engine torque from moving the machine. Examples of high speed vertical axis machine may be found in U.S. Pat. Nos. 5,253,384; 4,358,868; 4,115,890 and U.S. Pat. No. 4,122,576.

Light weight floor polishers are known in the art with patents dating back to the turn of the century. U.S. Pat. No. 981,032 issued in 1911 sets forth a lightweight floor scrubbing device. U.S. Pat. Nos. 1,847,323; 2,561,279 & 3,074,089 all depict lightweight floor brushes. However, none of these are high speed or utilize self-contained detachable handles. U.S. Pat. No. 6,353,957 issued 2002 depicts the state of the art floor polisher and exemplifies how complex the polishers have become making them unwieldy for transport and cost prohibitive for the average consumer.

Orbital polishers are used for hand polishing of an automobile surface. The higher polishing speeds, approximately 4000 rpm, is used to prevent swirl marks on delicate laquer paint jobs but fail to clean the grit typically found on floors. The hand polishers are designed to be light in weight so that burning of the surfaces does not occur. However, such polishers are not readily used to treat floors for the polishing of floors as current practices to maintain polishers of a slow speed and heavy body for use in those instances that are commonly soiled and thus require polishing for refurbishing.

What is lacking in the art is an inexpensive light weight floor polisher that is capable of operating at a high rotation speed to eliminate motor torque.

SUMMARY OF THE INVENTION

Disclosed is a device that allows for high speed floor polishing. The device is a conventional hand polisher that is adapted for use on floors through the coupling of a handle to the hand polisher. The handle includes an area for holding weight for those instances where increased polisher head pressure is required. Alternatively the area operates as a storage area for polishing compounds.

The polisher employed is that of a commercially available 12" or larger hand polisher operating at 4000 rpm. The use of the high speed polisher eliminates the torque twist found in conventional floor polishers by use of a speed that prevents frictional engagement with the floor. Operator fatigue is eliminated by removal of the torque. The use of the commonly available hand polishers are beneficial in that they are light in weight and affordable due to mass production.

Thus, an objective of the instant invention is to take advantage of a mass produced hand polisher for use as a floor polisher by attaching a handle and providing a composition that operates at the higher rotation speeds.

Still another objective of the instant invention is to disclose the use of a floor polisher whose weight can be adjusted to meet the type of floor ss to prevent marring of the surface or burning of the applied polishing material.

Still another objective of the instant invention is to disclose a polishing compound for use with high speed lightweight orbital polishers for routine polishing of floor surfaces.

Still another objective of the instant invention is to disclose a high speed floor polisher that is highly maneuverable in view of its weight allowing polishing on a daily basis so as to eliminate the need for low speed heavy polishers typically used on a monthly or yearly basis.

Other objectives and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION

Figure 1:
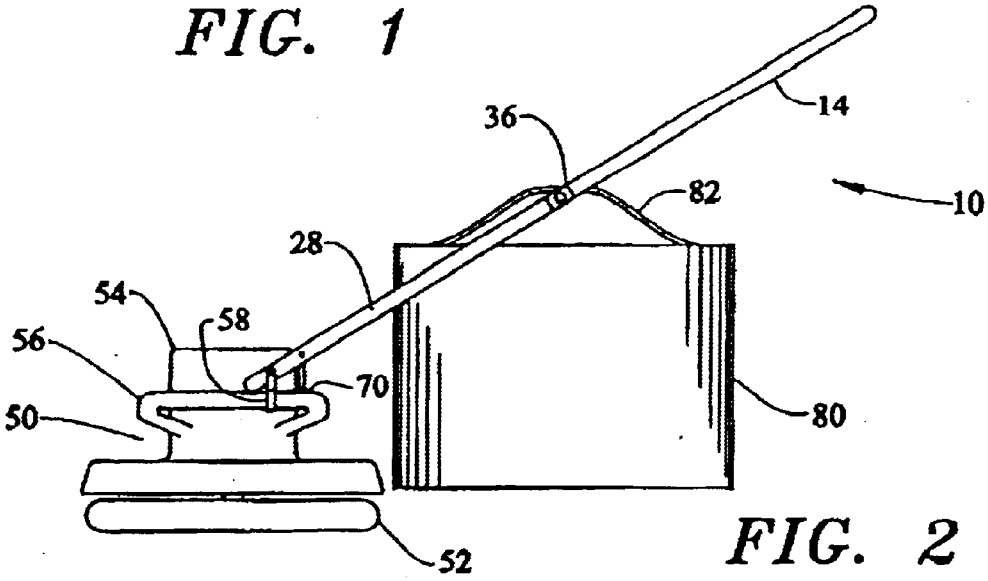
FIG. 1 is a side view of the polisher device accordingly to the instant invention.
Figure 2:
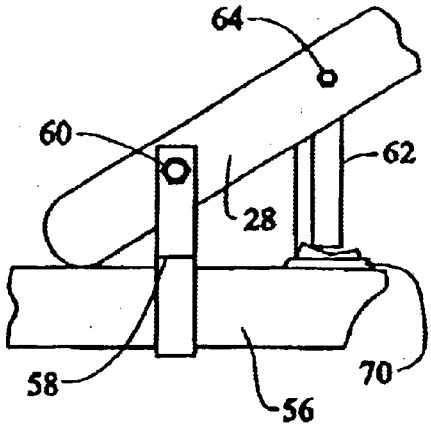
FIG. 2 is an enlarged view of the handle to polisher coupling.
Figure 3:
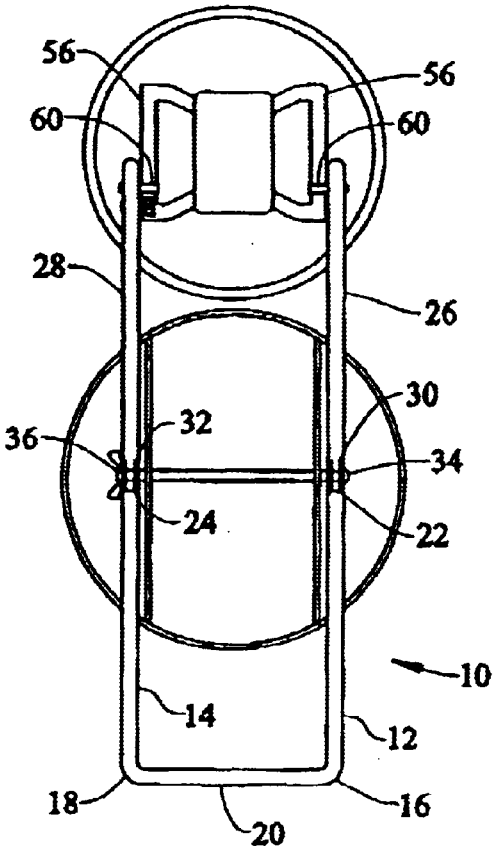
FIG. 3 is a front perspective view.

Although the invention will be described in terms of a specific embodiment, it will be readily apparent to those skilled in this art that various modifications, rearrangements and substitutions can be made without departing from the spirit of the invention. The scope of the invention is defined by the claims appended hereto.

Now referring to the figures in general, set forth is the preferred embodiment of the invention comprising a storable handle 10 for use with most any style of high speed hand operated polishers. The handle is defined by a first upper shaft 12 and a second upper shaft 14 positioned parallel to each other. Distal ends 16 and 18 of each shaft are secured in a fixed position by upper cross member 20, preferably formed from a single piece of steel or rigid plastic. Proximal ends 22 and 24 of each shaft are secured to lower shaft 26 and shaft 28 along top ends 30 and 32. The shafts can be centrally secured in a spaced apart position by use of coupling bolt 34 that extends through all the shafts creating a pivot point for folding. Fastening wing nut 36 allows a quick release of the shafts so that the upper shafts may fold over onto the lower shafts. As an alternative embodiment, not shown, the upper shafts may sized so they may slide within the lower shafts wherein a spring loaded locking pin can be used to maintain the shafts in a fixed position.

The orbital sander 50 depicted such as the Craftsman 9" or 12" car polishers, includes a polishing bonnet 52 rotated by an electric motor 54 placed over the bonnet 52. The rotation of the bonnet is considered high speed, approximately 4000 rpms designed for paints that are unable to handle high pressure/heat during the polishing step. The use of a polisher designed for automobiles takes advantage of the light weight necessary to prevent paint etching on lacquer, enamels or other automobile surfaces. Further, the economics of adapting a car polisher wherein the large volume of sales depresses the cost of the polishers making them an affordable base for use with floors. However, the high speed requires the use of a polishing compound that fuses at that higher rpm's with reduced pressure to the applicator/bonnet. The hand holds 56 on the polisher 50 are used to receive the lower handle shafts 26 and 28 and are secured thereto by use of clamps 58. The clamps 58 wrap around the hand holds and fasten to each shaft by use of a fastening bolt 60. The clamps allow for a quick release of the handle thereby providing a dual function for the polisher, that is as a hand held polisher or as a handle controlled floor polisher. The detachable handle can also be placed in a storage bin as will be described later in the specification.

In a preferred embodiment an actuator clamp 62 can also be secured to the shaft 28, by fastener 64, for engaging of the on/off switch 70. Commercial high speed orbital polisher have a spring loaded on/off switch requires a constant pressure for actuation. For constant actuation polishers, the actuator clamp 62 can be adjusted wherein a slight rotation of the handle will depress the on/off switch 70 allowing operation of the polisher. On industrial style hand polishers, the on/off switch does not require a constant pressure for activation.

A storage bin 80 provides a container for holding polishing compounds while the polisher is in operation. In addition, where a high temperature polish is employed requiring the generation of a high heat for activation, the use of the storage bin for holding of weight provides additional friction during rotation permitting a high temperature application. The storage bin 80 is secured to the handle 10 along coupling pin 34 by use of hanger bracket 82. The hanger bracket 82 may be in the form of a hook to allow ease of removal from the coupling pin 34 or include an aperture that encompasses the coupling pin to prevent disengagement.

Figure 4:
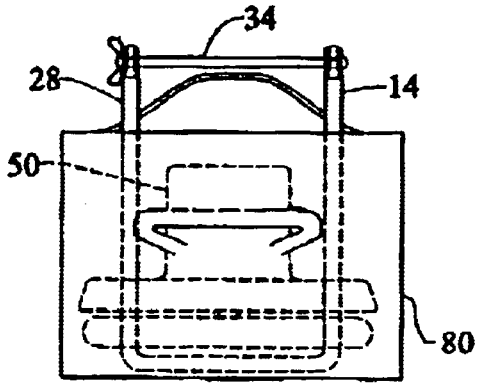
FIG. 4 is a side view of the polisher device in a storage position.

As shown in FIG. 4, the storage bin 80 further operates as a storage bin for all components including the polisher. In this matter, when the bin 80 is coupled to the handle, the bin 80 is available for holding the polisher 50, the handle 10, as well as polishing compounds and weights. The storage bin 80 allows the operator to keep all floor polishing materials in a single area making the process of assembly and floor treatment less troublesome.

It is to be understood that while I have illustrated and described certain forms of my invention, it is not to be limited to the specific forms or arrangement of parts herein described and shown. It will be apparent to those skilled in the art that various changes may be made without departing from the scope of the invention and the invention is not to be considered limited to what is shown in the drawings and described in the specification.

What I claim is:

1. A storable handle for an electric hand-held polisher having a drive motor positioned above a rotating polishing pad therebetween, and opposing hand grips, said storable handle comprising:

an upper handle portion having first and second upper shafts positioned parallel, each said shaft having a distal end and a proximal end, said distal ends secured in a fixed position by an upper cross member;

a lower handle portion having first and second lower shafts positioned parallel, each said shaft having a top end securable to a proximal end of said upper handle and a bottom end coupled to an electric hand-held polisher; and a storage bin having a bottom wall and four side walls securable to the shafts of said lower handle, said storage bin capable of holding weighted objects for applying pressure to the polishing pad of an electric hand-held polisher;

whereby said upper and lower handle form a rigid extension having a length allowing an operator to control an electric hand-held polisher while standing wherein said upper and lower handle are storable by reduction of the extension length.

2. The storable handle according to claim 1 wherein said proximal ends of said upper handle are hingedly coupled to said top ends of said lower handle.

3. The storable handle according to claim 1 wherein said proximal ends of said upper handle are sized to slidably insert into said top ends of said lower handle.

4. The storable handle according to claim 1 wherein said upper cross member includes a hand grip.

5. The storable handle according to claim 1 wherein said bottom end of said lower handle is coupled to an electric hand-held polisher by a releaseable fastener.

6. The storable handle according to claim 5 wherein said releaseable fastener is defined as a hook shaped member that depends downwardly from each bottom end for engaging the hand grip of an electric hand-held polisher.

7. The storable handle according to claim 5 wherein said releaseable fastener is defined as a coupling bracket that allows each bottom end to be respectively bolted to the opposing hand grips of an electric hand-held polisher.

8. The storable handle according to claim 1 wherein said storage bin is sized to hold said handle and an electric hand-held polisher.

9. A storable handle for an electric hand-held polisher having a drive motor positioned above a rotating polishing pad with hand grips formed therebetween wherein said storable handle is attachable to the hand grips, said storable handle comprising:

an upper handle portion having first and second upper shafts positioned parallel, each said shaft having a distal end and a proximal end, said distal ends secured in a fixed position by an upper cross member having a hand grip;

a lower handle portion having first and second lower shafts positioned parallel, each said shaft having a top end securable to a proximal end of said upper handle and a hook shaped member that depends downwardly from each bottom end for engaging the hand grip of an electric hand-held polisher; and a storage bin having a bottom wall and four side walls securable to the shafts of said handle, said storage bin capable of holding weighted objects for applying pressure to the polishing pad of an electric hand-held polisher;

whereby said upper and lower handle form a rigid extension having a length allowing an operator to control an electric hand-held polisher while standing wherein said upper and lower handle are storable by reduction of the extension length.

10. The storable handle according to claim 9 wherein said proximal ends of said upper handle are hingedly coupled to said top ends of said lower handle.

11. The storable handle according to claim 9 wherein said proximal ends of said upper handle are sized to slidably insert into said top ends of said lower handle.

12. The storable handle according to claim 9 wherein said storage bin is sized to hold said handle and an electric hand-held polisher.

13. An electric hand-held polisher conversion kit for use with an electric hand-held polisher having a drive motor positioned above a rotating polishing pad with hand grips formed therebetween, said kit comprising:

a foldable handle having a gripping portion and an attachment portion, said attachment portion engageable with a hand grip of an electric hand-held polisher;

a storage bin sized to store an electric hand-held polisher and said handle when not in use, said storage bin securable to said handle when an electric hand-held polisher is in use.

14. An orbital electric polisher assembly, comprising:

an electric hand-held polisher having a drive motor positioned above a rotating polishing pad, said electric hand-held polisher having left and right opposing hand grips;

a handle selectively attachable to and detachable from said pair of opposing hand grips, said handle comprising an upper handle portion having first and second upper shafts positioned parallel to one another, each said shaft having a distal end and a proximal end, said distal ends secured in a fixed position by an upper cross member; a lower handle portion having first and second lower shafts positioned parallel to one another, each said shaft having a top end securable to a proximal end of said upper handle and a bottom end terminating in a clamp adapted to engage with one of said opposing hand grips;

first and second releasable fastener means for securing said clamps on said first and second lower shafts to said opposing hand grips;

whereby said orbital electric polisher has a first mode of operation as a handle controlled floor polisher when said handle is in an attached configuration and a second mode of operation as a hand-held polisher when said handle is in a detached configuration.

15. The orbital polisher assembly according to claim 14 wherein said proximal ends of said upper handle are hingedly coupled to said top ends of said lower handle.

16. The orbital polisher assembly according to claim 14 wherein said proximal ends of said upper handle are sized to slidably insert into said top ends of said lower handle.

17. The orbital polisher assembly according to claim 14 wherein said upper cross member includes a hand grip.

18. The orbital polisher assembly according to claim 14 wherein said releaseable fastener is defined as a coupling bracket that allows each bottom end to be bolted to the hand grip of said electric hand-held polisher.

19. The orbital polisher assembly according to claim 14 including a storage bin having a bottom wall and four side walls is securable to the shafts of said lower handle, said storage bin capable of holding weighted objects for applying pressure to the polishing pad of said electric hand-held polisher.

20. The orbital polisher assembly according to claim 14 wherein said storage bin is sized to hold said handle and said electric hand-held polisher.

21. The orbital polisher assembly according to claim 14 wherein said electric hand-held polisher has a rotational speed of approximately 4000 rpm.

22. The orbital polisher assembly according to claim 14 wherein said storable handle further includes an actuator lever for turning on said electric hand-held polisher.

* * * * *